US005828994A

United States Patent [19]

Covell et al.

[11] Patent Number: 5,828,994

[45] Date of Patent: Oct. 27, 1998

[54] NON-UNIFORM TIME SCALE MODIFICATION OF RECORDED AUDIO

[75] Inventors: Michele Covell; M. Margaret Withgott, both of Los Altos Hills, Calif.

[73] Assignee: Interval Research Corporation, Washington, D.C.

[21] Appl. No.: 659,227

[22] Filed: Jun. 5, 1996

[51] Int. Cl.[6] ..... G10L 9/00

[52] U.S. Cl. ..... 704/211; 704/503; 704/504

[58] Field of Search ..... 395/2.94, 2.95, 395/2.2; 704/211, 503, 504

[56] References Cited

U.S. PATENT DOCUMENTS

| | | | |
|---|---|---|---|
| 4,910,780 | 3/1990 | Miki | 395/2.2 |
| 5,175,769 | 12/1992 | Hejna, Jr. et al. | 395/2.2 |
| 5,327,518 | 7/1994 | George et al. | 395/2.2 |
| 5,341,432 | 8/1994 | Suzuki et al. | 395/2.2 |
| 5,473,759 | 12/1995 | Slaney et al. | 704/266 |
| 5,577,159 | 11/1996 | Shoham | 395/2.2 |

FOREIGN PATENT DOCUMENTS

| | | |
|---|---|---|
| 0 605 348 A | 7/1994 | European Pat. Off. . |
| 0 652 560 A | 5/1995 | European Pat. Off. . |
| 0 702 354 A | 3/1996 | European Pat. Off. . |

OTHER PUBLICATIONS

Chen, Francine R. et al, "The Use of Emphasis to Automatically Summarize a Spoken Discourse." Institute of Electrical and Electronics Engineers, vol. 1, 23 Mar. 1992, San Francisco, pp. 229–232.

Labonté, Daniel et al. "Méthod de Modification de l'Échelle Temps d'Enregistrements Audio, pour la Réécoute á Vitesse Variable en Temps Réel." Proceedings of Canadian Conference on Electrical and Computer Engineering, vol. 1, 14–17 Sep. 1993, Vancouver, BC, Canada, pp. 277–280.

Quatieri, Thomas F. et al, "Shape Invariant Time–Scale and Pitch Modification of Speech", *IEEE Transactions on Signal Processing*, vol. 40, No. 3, Mar. 1992, pp. 497–510.

*Primary Examiner*—David R. Hudspeth
*Assistant Examiner*—Susan Wieland
*Attorney, Agent, or Firm*—Burns, Doane, Swecker & Mathis, L.L.P.

[57] ABSTRACT

To modify the temporal scale of recorded speech, relative stress and relative speaking rate terms are computed for individual sections, or frames, of the speech. These terms are then combined into a single value denoted as audio tension. For a nominal time-scale modification rate, the audio tension is employed to adjust the modification rate of the individual frames of speech in a non-uniform manner, relative to one another. With this approach, compressed speech can be reproduced at a relatively fast rate, while remaining intelligible to the listener.

46 Claims, 4 Drawing Sheets

NON-UNIFORM TIME SCALE MODIFICATION OF RECORDED AUDIO

FIELD OF THE INVENTION

The present invention relates to the modification of the temporal scale of recorded audio such as speech, for expansion and compression during playback, and more particularly to the time scale modification of audio in a manner which facilitates high rates of compression and/or expansion while maintaining the intelligibility of the resulting sounds.

BACKGROUND OF THE INVENTION

There are various situations in which it is desirable to modify the temporal scale of recorded audio sounds, particularly speech. In some instances, a listener may desire to slow the rate at which the speech is reproduced, for better comprehension or to facilitate transcription. Conversely, at other times the user may desire to accelerate the playback, for example while listening to a recorded lecture or a voicemail message, so that less time is spent during the listening process. As another example, when synchronizing an audio recording to another stream of media, such as video, it may be necessary to compress or expand the recorded audio to provide synchronization between the two types of media.

Conventionally, time scale modification of audio has been carried out at a uniform rate. For example, in a tape recorder, if it is desired to replay a speech at 1.5 times its original rate, the tape can be transported at a faster speed to accelerate the playback. However, as the playback speed increases, the pitch of the reproduced sound also increases, resulting in a "squeaky" tone. Conversely, as the playback speed is reduced below normal, a lower pitched, more bass-like tonal quality, is perceived.

More sophisticated types of playback devices provide the ability to adjust the pitch of the reproduced sound. In these devices, as the playback speed is increased, the pitch can be concomitantly reduced, so that the resulting sound is more natural. Even with this approach, however, when uniform compression or expansion rates are used, there is a practical limit to the amount of modification that can be obtained. For example, for speech compression at a uniform rate, the maximum playback speed is approximately two times the original recorded rate. If the speech is played back at a higher rate, the resulting sound is so unnatural that the content of the speech becomes unintelligible.

The unnatural sound resulting from significantly accelerated speech is not due to the change in speech rate itself. More particularly, when humans speak, they naturally increase and decrease their speech rate for many reasons, and to great effect. However, the difference between a person who speaks very fast and a recorded sound that is reproduced at a fast rate is the fact that human speakers do not change the speech rate uniformly. Rather, the change is carried out in varying amounts within very fine segments of the speech, each of which might have a duration of tens of milliseconds. The non-uniform rate change is essentially controlled by a combination of linguistic factors. These factors relate to the meaning of the spoken sound and form of discourse (a semantic contribution), the word order and structure of the sentences (syntactic form), and the identity and context of each sound (phonological pattern).

Theoretically, therefore, non-uniform variation of a recorded speech can be achieved by recognizing linguistic factors in the speech, and varying the rate of reproduction accordingly. For example, it might be possible to use speech recognition technology to perform syntactic and phonological analysis. In this regard, duration rules have been developed for speech synthesis, which address the fine-grain changes associated with phonological and syntactic factors. However, there are limitations associated with such an approach. Specifically, if the time course of a recording is altered on the basis of duration rules that are devised for speech synthesis, the resulting speech may be altered in a manner not intended by the speaker. For example, if semantic and pragmatic factors are not controlled, an energetic speaker might sound bored. Furthermore, automatic speech recognition is computationally expensive, and prone to significant errors. As such, it does not constitute a practical basis for time scale modification.

It is desirable, therefore, to provide time scale modification of audio signals in a non-uniform manner that takes into consideration the different characteristics of the component sounds which make up the signal, without requiring speech recognition techniques, or the like.

BRIEF STATEMENT OF THE INVENTION

In accordance with the foregoing objective, the present invention provides a non-uniform approach to time scale modification, in which indirect factors are employed to vary the rate of modification. In normal speech, when a particular portion of speech is to be highlighted, the speaker tends to pronounce the words more loudly and slowly. Thus, when a listener is meant to understand a message thoroughly, the speaker carefully articulates the words, whereas the speaker may murmur, mutter and mumble when choosing to portray expressive content rather than denotation. To preserve the natural intent of the speaker, therefore, time scale modification in accordance with the invention accelerates those portions of speech which a speaker naturally speeds up to a greater extent than the portions in which the speaker carefully articulates the words. With such an approach, the intended emphasis provided by the speaker is maintained, and thus remains more intelligible to the listener at non-real-time rates.

From a conceptual standpoint, the different portions of speech can be classified in three broad categories, namely (1) pauses, (2) unstressed syllables, words and phrases, and (3) stressed syllables, words and phrases. In accordance with the foregoing principles, when a speech signal is compressed, pauses are accelerated the most, unstressed sounds are compressed an intermediate amount, and stressed sounds are compressed the least. In accordance with one aspect of the invention, therefore, the relative stress of different portions of recorded speech is measured, and used to control the compression rate. As one measure of relative stress, an energy term for speech can be computed, and serves as a basis for distinguishing between these different categories of speech.

In addition to the different types of speech, consideration is also given to the speed at which a given passage of speech was originally spoken. By taking this factor into account, sections of speech that were originally spoken at a relatively rapid rate are not overcompressed. In accordance with another aspect of the invention, therefore, the original speaking rate is measured, and used to control the compression rate. In one embodiment, spectral changes in the content of the speech can be employed as a measure of speaking rate.

In the preferred embodiment of the invention, relative stress and relative speaking rate terms are computed for individual sections, or frames, of speech. These terms are then combined into a single value denoted as "audio tension." For a nominal compression rate, the audio tension is employed to adjust the time scale modification of the individual frames of speech in a non-uniform manner, relative to one another. With this approach, the compressed speech can be reproduced at a relatively fast rate, while remaining intelligible to the listener.

The foregoing features of the invention, and the advantages attained thereby, are explained in greater detail hereinafter with reference to illustrative embodiments depicted in the accompanying drawings.

DETAILED DESCRIPTION

Generally speaking, the present invention is directed to the time scale modification of recorded, time-based information. To facilitate an understanding of the principles which underlie the invention, it will be described with specific reference to its application in the field of speech compression. In such a context, the process of the invention involves the analysis of recorded speech to determine audio tension for individual segments thereof, and the reproduction of the recorded speech at a non-uniform rate determined by the audio tension. It will be appreciated that the practical applications of the invention are not limited to speech compression. Rather, it can be used for expansion as well as compression, and can be applied to sounds other than speech, such as music. The results of audio signal analysis that are obtained in accordance with the present invention can be applied in the reproduction of the actual signal that was analyzed, and/or other media that is associated with the audio that is being compressed or expanded.

Figure 1:
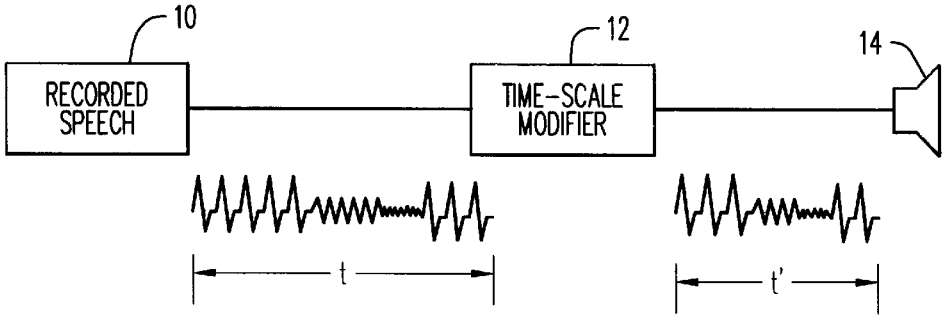
FIG. 1 (PRIOR ART)
FIG. 1 is an overall block diagram of a time-scale modification system for speech.

FIG. 1 is a general block diagram of a conventional speech compression system in which the present invention can be implemented. This speech compression system can form a part of a larger system, such as a voicemail system or a video reproduction system. Speech sounds are recorded in a suitable medium 10. For example, the speech can be recorded on magnetic tape in a conventional analog tape recorder. More preferably, however, the speech is digitized and stored in a memory that is accessible to a digital signal processor. For example, the memory 10 can be a magnetic hard disk or an electronic memory, such as a random access memory. When reproduced from the storage medium 10 at a normal rate, the recorded speech segment has a duration t.

To compress the speech, it is processed in a time scale modifier 12 in accordance with a desired rate. Depending upon the particular environment, the time scale modifier can take many forms. For example, in an analog tape recorder, the modifier 12 might simply comprise a motor controller, which regulates the speed at which magnetic tape is transported past a read head. By increasing the speed of the tape, the speech signal is played back at a faster rate, and thereby temporally compressed into a shorter time period t'. This compressed signal is provided to a speaker 14, or the like, where it is converted into an audible signal.

In the preferred embodiment of the invention, in which the original speech signal is stored in the medium 10 in a digitized form, the time scale modifier is a digital signal processor. For example, the modifier could be a suitably programmed computer which reads the recorded speech signal from the medium 10, processes it to provide suitable time compression, and converts the processed signal into an analog signal, which is supplied to the speaker 14.

Various known methods can be employed for the time scale modification of the speech signal in a digital signal processor. In the frequency domain, modification methods which are based upon short-time Fourier Transforms are known. For example, a spectrogram can be obtained for the speech signal, and the time dimension of the spectrogram can be compressed in accordance with a target compression rate. The compressed signal can then be reconstructed in the manner disclosed in U.S. Pat. No. 5,473,759, for example. Alternatively, time domain compression methods can be used. One suitable method is pitch-synchronous overlap-add, which is referred to as PSOLA or SOLA. The speech signal is divided into a stream of short-time analysis signals, or frames. Overlap-add synthesis is then carried out by reducing the spacing between frames in a manner that preserves the pitch contour. In essence, integer numbers of periods are removed to speed up the speech. If speech expansion is desired, the spacing between frames is increased by integer multiples of the dominant fundamental period.

Figure 2:
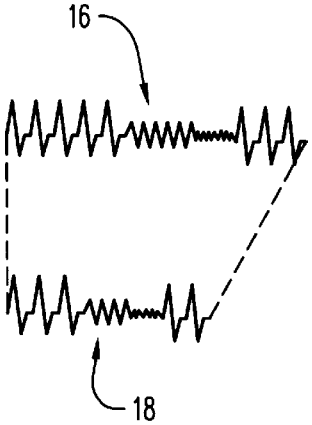
FIG. 2 is an illustration of the compression of a speech signal.

In a conventional speech compression system, the warping of the time scale for the signal is carried out uniformly (to within the jitter introduced by pitch synchronism). Thus, referring to FIG. 2, the time-scale modification technique is uniformly applied to each individual component of an original signal 16, to produce a time compressed signal 18. For example, if the SOLA method is used, the spacing between frames is reduced by an amount related to the compression rate. Within the time compressed signal 18, each of the individual components of the signal has a time duration which is essentially proportionally reduced relative to that of the original signal 16.

When uniform compression is applied throughout the duration of the speech signal, the resulting speech has an unnatural quality to it. This lack of naturalness becomes more perceivable as the modification factor increases. As a result, for relatively large modification factors, where the ratio of the length of the original signal to that of the compressed signal is greater than about 2, the speech is sufficiently difficult to recognize that it becomes unintelligible to the average listener.

In accordance with the present invention, a more natural-sounding modified speech can be obtained by applying non-uniform compression to the speech signal. Generally speaking, the compression rate is modified so that greater compression is applied to the portions of the speech which are least emphasized by the speaker, and less compression is applied to the portions that are most emphasized. In addition, the original speaking rate of the signal is taken into account, in determining how much to compress it. Thus, the original speech signal is first analyzed to determine relevant characteristics, which are represented by a value identified herein as audio "tension." The audio tension of the signal is then used to control the compression rate in the time scale modifier 12.

Figure 3:
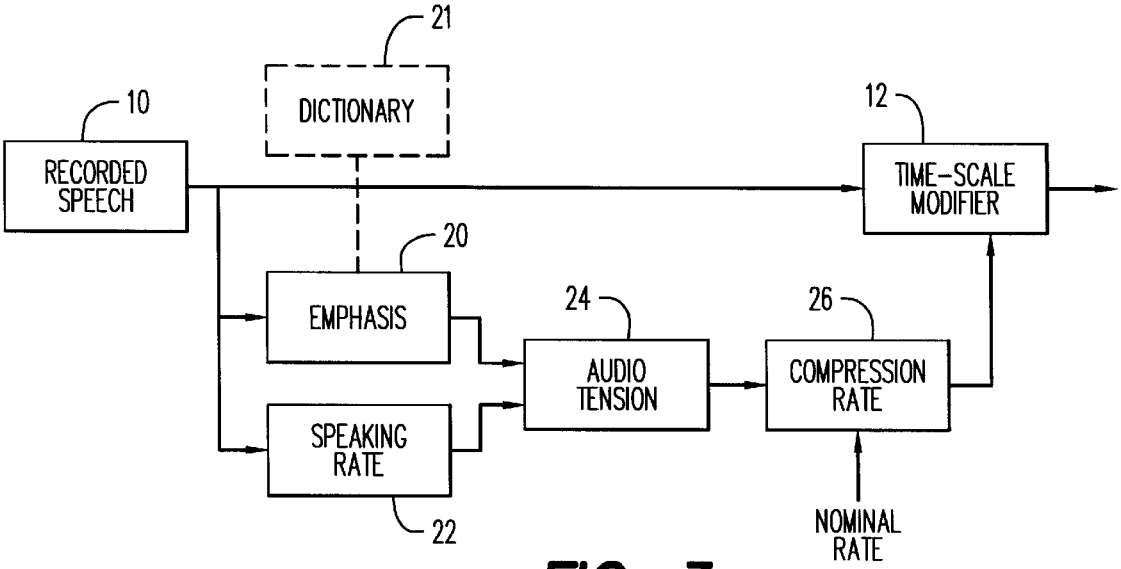
FIG. 3 is a more detailed block diagram of a system for temporally modifying speech in accordance with the present invention.

Audio tension is comprised of two basic parts. Referring to FIG. 3, the recorded speech stored in the medium 10 is analyzed in one stage 20 to determine the relative emphasis placed on different portions thereof. In one embodiment of the invention, the energy content of the speech signal is used as a measure of relative emphasis. Other approaches which can be used to measure relative emphasis include statistical classification (such as a hidden Markov model (HMM) that is trained to distinguish between stressed and unstressed versions of speech phones) and analysis of aligned word-level transcriptions of utterances, with reference to a pronunciation dictionary based on parts of speech. In this latter approach, each utterance is transcribed, for example by using conventional speech-to-text conversion, and the transcription is used to access a dictionary 21, which defines each utterance in terms of its relative emphasis. In general, a vowel will be defined as having a higher amount of relative stress and consonants will be defined to have a lesser amount of stress. The following discussion of the invention will be made with reference to an embodiment in which energy content is used as the measure of relative emphasis. It will be appreciated, however, that other forms of measurement can also be utilized.

Conceptually, the energy in the speech signal enables different components thereof to be identified as pauses (represented by near-zero amplitude portions of the speech signal), unstressed sounds (low amplitude portions) and stressed sounds (high amplitude portions). Generally speaking, it is desirable to compress pauses the most, stressed sounds the least, and unstressed sounds by an intermediate amount. In the practice of the invention, the different components of the speech are not rigidly classified into the three categories described above. Rather, the energy content of the speech signal appears over a continuous range, and provides an indicator of the amount that the speech should be compressed in accordance with the foregoing principle.

The other factor of interest is the rate at which the sounds were originally spoken. For sounds that were spoken relatively rapidly, the compression rate should be lower, so that the speech is not overcompressed. Accordingly, the original speech signal is also analyzed to estimate relative speaking rate in a second stage 22. In one embodiment of the invention, spectral changes in the signal are detected as a measure of relative speaking rate. In another embodiment, a measure derived from statistical classification, such as phone duration estimates using the time between phone transitions, as estimated by an HMM that is normalized with respect to the expected duration of the phones, can be used to determine the original speaking rate. As another example, the speaking rate can be determined from syllable duration estimates obtained from an aligned transcript that is normalized with respect to an expected duration for the syllables. In the discussion of one embodiment of the invention which follows, spectral change is employed as the measure of the original speaking rate.

A relative emphasis term computed in the stage 20 and a speaking rate term computed in the stage 22 are combined in a further stage 24 to form an audio tension value. This value is used to adjust a nominal compression rate applied to a further processing stage 26, to provide an instantaneous target compression rate. The target compression rate is supplied to the time scale modifier 12, to thereby compress the corresponding portion of the speech signal accordingly.

The signal analysis which occurs in the stages 20, 22 and 24 will now be described in the context of an exemplary implementation of the invention. It will be appreciated that the details of such implementation are illustrative, for purposes of ready comprehension. Alternative approaches to those described herein will be apparent, and can likewise be employed in the practice of the invention.

To provide a local measure of emphasis, a value derived from the local energy is used. An energy-based measure can be used to estimate the emphasis of a speech signal if:

- its measure of energy is local and dynamic enough to allow changes on the time scale of a single syllable or less, so it can measure the emphasis at the scale of individual syllables;
- its measure of energy is normalized to the long-term average energy values, allowing it to measure relative changes in energy level, so it can capture the relative changes in emphasis;
- its measure of energy is compressive, allowing smaller differences at lower energy levels (such as between fricatives and pauses) to be considered, as well as the larger differences in higher energy levels (such as between a stressed vowel and an unstressed vowel), so that it can capture the relative differences between stressed, unstressed, and pause categories;
- its measure of energy is stable enough to avoid large changes within a single syllable, so that it can measure the emphasis over a full syllable and not over individual phonemes, accounting for temporal grouping effects in speech perception;
- its measure of energy includes some temporal hysteresis, so that perceptual artifacts (such as false pitch resets) are avoided.

Figure 4:
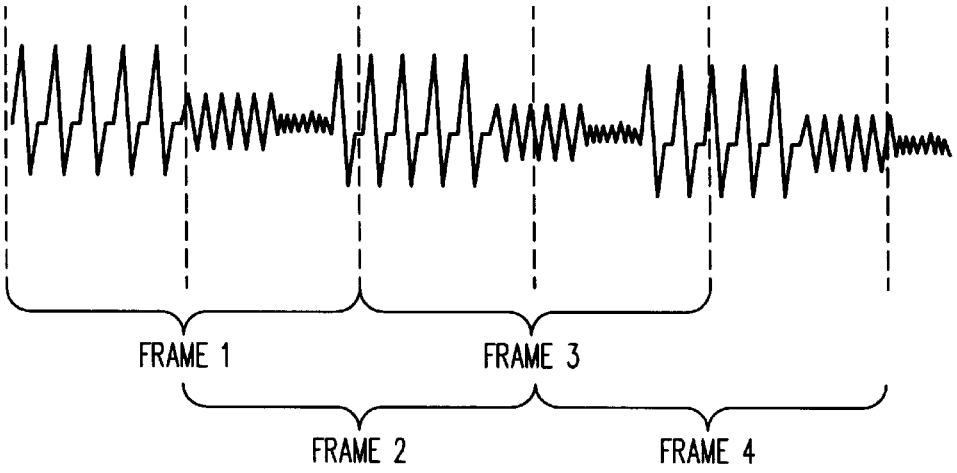
FIG. 4 is an illustration of a speech signal that is divided into frames.

The following embodiment provides one method for achieving these goals using an energy-based measure. Referring to FIG. 4, the speech signal is divided into overlapping frames of suitable length. For example, each frame could contain a segment of the speech within a time span of about 10–30 milliseconds. The energy of the signal is determined for each frame within the emphasis detecting stage 20. Generally speaking, the energy refers to the integral of the square of the amplitude of the signal within the frame. A single energy value is computed for each frame.

In the preferred implementation of the invention, it is desirable to normalize the local energy in each frame relative to the long-term amplitude, to provide a measure of energy that captures the relative changes in emphasis. This normalization can be accomplished by computing a value known as relative frame energy. To compute such a value, the frame energy at the original frame rate is first determined. The average frame energy over a number of contiguous frames is also determined. In one embodiment, the average frame energy can be measured by means of a single-pole filter having a suitably long time constant. For example, if the frames have a duration of 10–30 milliseconds, as described above, the filter can have a time constant of about one second. The relative frame energy is then computed as the ratio of the local frame energy to the average frame energy.

The relative frame energy value can then be mapped onto an amplitude range that more closely matches the variations of relative energy across the frames. This mapping is preferably accomplished by a compressive mapping technique that allows small differences at lower energy levels (such as between fricatives and pauses) to be considered, as well as the larger differences at higher energy levels (such as between a stressed vowel and an unstressed vowel), to thereby capture the full range of differences between stressed sounds, unstressed sounds and pauses. In one embodiment, this compressive mapping is carried out by first clipping the relative frame energy values at a maximum value, e.g., 2. This clipping prevents sounds with high energy values, such as emphasized vowels, from completely dominating all other sounds. The square roots of the clipped values are then calculated to provide the mapping. The values resulting from such mapping are referred to as "local frame emphasis."

Figure 5:
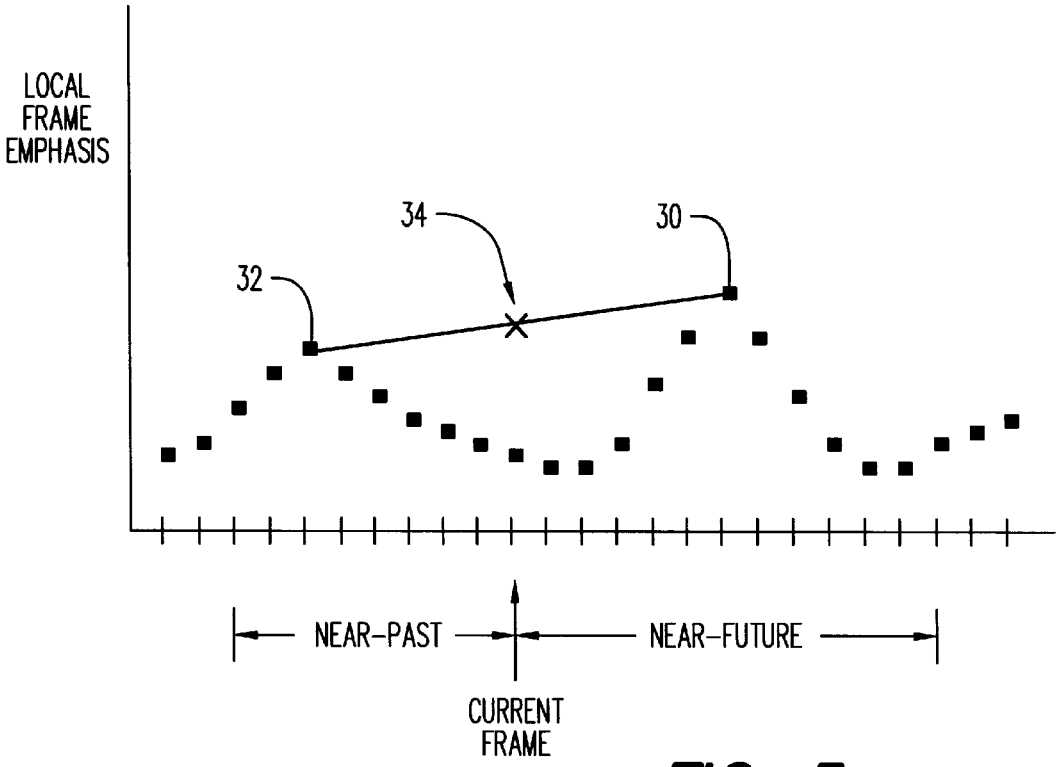
FIG. 5 is a graph of local frame emphasis for a speech signal, showing the computation of a tapered temporal hysteresis.

Preferably, the local frame emphasis is modified to account for temporal grouping effects in speech perception and to avoid perceptual artifacts, such as false pitch resets. Typically, sounds for consonants tend to have less energy than sounds for vowels. Consider an example of a two-syllable word, in which one syllable is stressed and one is unstressed. The vowel in the unstressed syllable may have a local frame emphasis which is higher than that for the consonants in the stressed syllable. When the word is spoken quickly, however, all of the parts of the unstressed syllable tend to get compressed as much, or more than, the portions of the stressed syllable. To account for this type of temporal grouping, a "tapered" temporal hysteresis is applied to the local frame emphasis to compute a local relative energy term. Referring to FIG. 5, a maximum near-future frame emphasis is defined as the maximum value 30 of the local frame emphasis within a hysteresis window from the current frame into the near future, e.g., 120 milliseconds. Similarly, a maximum near-past frame emphasis is defined as the maximum value 32 within a hysteresis window from the current frame into the near past, e.g., 80 milliseconds. A linear interpolation is applied to the near-future and near-past maximum emphasis points, to obtain the local relative energy term 34 for the current frame. This approach boosts the sounds of consonants which are near vowels that exhibit high energy. It also reduces false perceptions of pitch resets which might otherwise occur in heavily compressed pauses, by increasing the relative energy of the portion of the pause near such vowels.

To provide a local measure of speaking rate, in one embodiment of the invention a measure derived from the rate of spectral change is computed in the speaking rate stage 22. It will be appreciated, however, that other measures of relative speaking rate can be employed, as discussed previously. A spectral-change-based measure can be used to estimate the speaking rate of a speech signal if:

- its measure of spectral change is local and dynamic enough to allow changes on the time scale of a single phone or less, so it can measure the speaking rate at the scale of individual phonemes;
- its measure of spectral change is compressive, allowing smaller differences at lower energy levels (such as between fricatives and pauses) to be considered, as well as the larger differences in higher energy levels (such as between a vowel and a nasal consonant), so it can measure changes at widely different energy levels;
- its measure of spectral change summarizes the changes seen in different frequency regions into a single measure of rate, so it can be sensitive to local shifts in format shapes and frequencies without being dependent on detailed assumptions about the speech production process; and
- its measure of spectral change is normalized to the long-term average spectral change values, allowing it to measure relative changes in the rate of spectral change, so it can capture the relative changes in speaking rate.

The following embodiment provides one method for achieving these goals in a spectral-change-based measure. Within the speaking rate detection stage 22, a spectrogram is computed for the frames of the original speech signal. For example, a narrow-band spectrogram can be computed using a 20 ms Hamming window, 10 ms frame offsets, a pre-emphasis filter with a pole at 0.95, and 513 frequency bins. The value in each bin represents the amplitude of the signal at an associated frequency, after low frequencies have been deemphasized within the filter. The frame spectral difference is computed using the absolute differences on the dB scale (log amplitude), between the current frame and the previous frame bin values. Using frame differences between neighboring frames with a short separation between them (e.g., 10–20 msec) provides a measure which is local and dynamic enough to allow changes on the time scale of a single phone or less, so it can measure the speaking rate at the scale of individual phonemes. Using a logarithmic measure of change allows smaller differences at lower energy levels to be considered, as well as the larger differences in higher energy levels. This allows changes to be measured at widely different energy levels, providing a measure of change that can deal with all types of speech sounds.

The absolute differences for the "most energetic" bins in the current frame are summed to give the frame spectral difference for the current frame. The most energetic bins are defined as those whose amplitudes are within 40 dB of the maximum bin. This provides a single measure of speaking rate which is sensitive to local shifts in format shapes and frequencies without being dependent on detailed assumptions about the speech production process.

In essence, the frame spectral difference is a single measure at each point in time of the amount by which the frequency distribution is changing, based upon a logarithmic measure of change.

To estimate the relative speaking rate, local values of frame spectral difference are normalized, to remove long-term averages. This is accomplished by estimating the average weighted spectral difference as a function of time. In the estimation of this average, low-energy frames can result in very large and unreliable values of frame spectral difference. It is therefore desirable to weight the average spectral difference by a non-linear function of relative frame energy which removes the adverse effects of low-energy frames. To this end, if the energy of a frame is not significant, e.g., less than 4% of local average, it is removed from consideration. The frame spectral difference values for the remaining frames are then low-pass filtered to obtain the average weighted spectral difference as a function of time. For example, the filter can have a time constant of one second.

The local relative rate of spectral change is then estimated, using the average weighted spectral difference, i.e. their ratio is computed. The resulting value can be limited, for example at a maximum value of 2, to provide balance between the energy term and the spectral change term.

Once the energy term and the spectral change terms have been computed in the stages 20 and 22, they are combined to form a single local tension value in the stage 24. As an example, the local tension value can be computed according to the following formula:

$$\text{tension}=a_{es}T_eT_s+a_eT_e+a_sT_s+a_0$$

where $T_e$ is the local relative energy term, $T_s$ is the local relative spectral change term, and $a_{es}$, $a_e$, $a_s$ and $a_0$ are constants. In one implementation of the invention, the constants have the values $a_{es}=0$, $a_e=1$, $a_s=½$ and $a_0=¼$. These values can be empirically determined, and adjusted over a wide range to produce varying results on different types of speech.

Once a tension value is computed for a frame, it is combined with a nominal compression rate to form a target compression rate in the stage 26. The nominal compression rate can be a constant, e.g., 2× real time. Alternatively, it can be a sequence, such as 2× real time for the first two seconds, 2.2× real time for the next two seconds, 2.4× real time for the next two seconds, etc. Such sequences of nominal compression rates can be manually generated, e.g., user actuation of a control knob on an answering machine for different playback rates at different points in a message, or they can be generated by automatic processing, such as speaker identification probabilities, as discussed in detail hereinafter. In the situation where the nominal compression rate comprises a sequence of values, it is preferable to preliminarily filter it with a low-pass filter, to eliminate sharp jumps in the target compression rate that would otherwise result from abrupt changes in the nominal compression rate. The target compression rate can then be established as the audio tension value divided by the nominal compression rate. The target compression rate is applied to the time scale modifier 12 to determine the actual compression of the current frame of the signal. The compression itself can be carried out in accordance with any suitable type of known compression technique, such as the SOLA and spectrogram inversion techniques described previously.

When the SOLA technique is used for time-scale modification, it is possible that artifacts, such as pops or clicks, will be perceived in the resulting sound, particularly at high compression rates. These artifacts are most likely to occur where the audio signal is aperiodic, for example when an unvoiced consonant appears immediately before or after a pause. Due to the presence of the pause, the compression rate is very high in these portions of the signal. As a result, the number of frames that are overlapped, pursuant to the SOLA technique, might be as much as 20–30, in contrast to the more typical 3–4 frames. This repeated overlapping of frames tends to remove the aperiodic energy in the unvoiced consonants. To the listener, this may be perceived as a truncation or complete omission of the beginning or ending sound of a word.

Figure 6A:
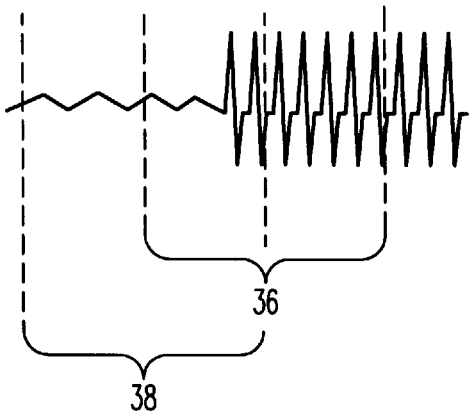
FIGS. 6A and 6B illustrate a modification of the SOLA compression technique in accordance with the present invention.
Figure 6B:
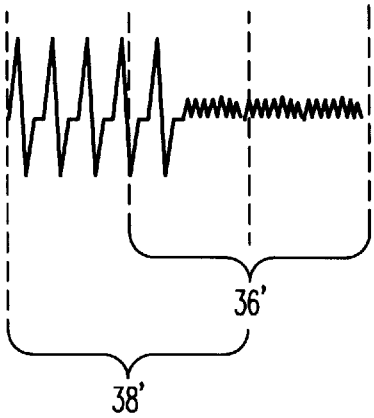

In a preferred implementation of the invention, the conventional SOLA technique is modified to avoid such a result. To this end, frames are identified whose primary component is aperiodic energy. Parts of these frames are maintained in the compressed output signal, without change, to thereby retain the aperiodic energy. This is accomplished by examining the high-frequency energy content of adjacent frames. Referring to FIG. 6A, if the current frame 36 has significantly more zero crossings than the previous frame 38, some of the previous frame 38 can be eliminated while at least the beginning of the current frame 36 is kept in the output signal. Conversely, as shown in FIG. 6B, if the previous frame 38' had significantly more zero crossings than the current frame 36', it is maintained and the current frame 36' is dropped in the compressed signal.

From the foregoing, it can be seen that the present invention provides non-uniform time scale modification of speech by means of an approach in which the overall pattern of a speech signal is analyzed across a continuum. The results of the analysis are used to dynamically adjust the temporal modification that is applied to the speech signal, to provide a more intelligible signal upon playback, even at high modification rates. The analysis of the signal does not rely upon speech recognition techniques, and therefore is not dependent upon the characteristics of a particular language. Rather, the use of relative emphasis as one of the controlling parameters permits the techniques of the present invention to be applied in a universal fashion to almost any language.

In practice, the present invention can be employed in any situation in which it is desirable to modify the time-scale of an audio signal, particularly where high rates of compression are desired. One application to which the invention is particularly well-suited is in the area of audio skimming. Audio skimming is the quick review of an audio source. In its simplest embodiment, audio skimming is constant-rate fast-forwarding of an audio track. This playback can be done at higher rates than would otherwise be comprehensible, by using the present invention to accomplish the time compression. In this application, a target rate is set for the audio track (e.g., by a fast forward control knob), and the track is played back using the techniques of the present invention.

In a more complex embodiment, audio skimming is variable rate fast-forward of an audio track at the appropriate time-compressed rates. One method for determining the target rate of the variable-rate compression is through manual input or control (e.g., a shuttle jog on a tape recorder control unit). Another method for determining the target rate is by automatically "searching" the video for the voice of a particular person. In this case, a text-independent speaker ID system, such as disclosed in D. Reyholds, "A Gaussian Mixture Modeling Approach to Text Independent Speaker Identification," Ph.D. Thesis, Georgia Institute of Technology, 1992, can be used to generate a stream of probabilities that a local section of audio (e.g., ⅓ second or 2 second section) is the recording of a chosen person's voice. These probabilities can be translated into a sequence of target compression rates. For example, the probability that a section of audio corresponds to a chosen speaker can be normalized relative to a group of cohorts (e.g., other modelled noises or voices). This normalized probability can then be used to provide simple monotonic mapping to the target compression rate.

Figure 7:
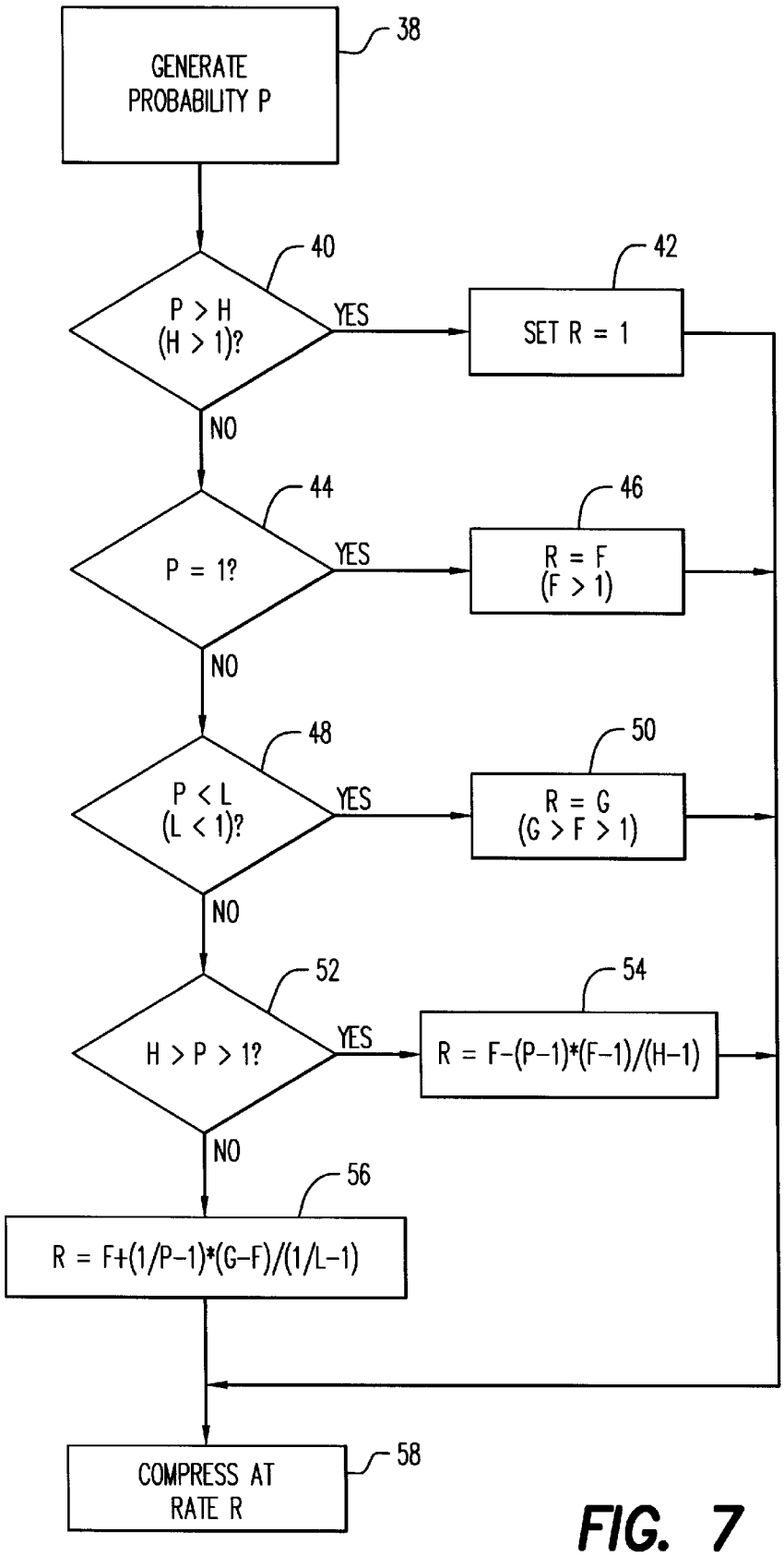
FIG. 7 is a flow chart of an audio skimming application of the present invention.

One example of compression rate control using such an approach is illustrated in the flowchart of FIG. 7. Referring thereto, at Step 38 a probability P is generated. This probability is a measure of the probability that the sound being reproduced is the voice of a given speaker relative to the probabilities for the cohorts. If the chosen speaker's relative probability P is larger than a preset high value H which is greater than 1 (e.g., 10 or more, so that the chosen speaker is 10 or more times more probable than the normalizing probability), the playback rate R is set to real time (no speed up) at Steps 40 and 42.

If the chosen speaker's relative probability P is equal to the normalizing probability at Step 44, the playback rate R is set to a compression value F greater than real-time, which will provide comprehensible speech (e.g., 2–3 times real time) at Step 46.

If the chosen speaker's relative probability P is less than a preset low value L which is less than 1 (e.g., 1/10 or less, so that the normalizing probability is 10 or more times more probable than the chosen speaker) at Step 48, the playback rate R is set either to some high value G at Step 50, or those portions of the recorded signal are skipped altogether. If "high values" in the range of 3–5 times real time are used, these regions will still provide comprehensible speech reproduction. If "high values" in the range of 10–30 times real time are used, these regions will not provide comprehensible speech reproduction but they can provide some audible clues as to the content of those sections.

If the chosen speaker's relative probability is in the range between high and one at Step 52, an affine function is used to determine playback rate, such as the one shown at Step 54.

Finally, if the chosen speaker's relative probability does not meet any of the criteria of Steps 40, 44, 48 or 52, it must be in the range between one and low. In this case, a function which is affine relative to the inverse of the relative probability is used to set the rate R, such as the one illustrated at Step 56. Thereafter, compression is carried out at the set rate, at Step 58.

It will be appreciated by those of ordinary skill in the art that the present invention can be embodied in other specific forms without departing from the spirit or essential characteristics thereof. For example, while specifically described in the context of speech compression, the principles of the invention are equally applicable to speech expansion. Furthermore, the non-uniform modification need not be applied only to the speech from which it is derived. Rather, it can be applied to other media as well, such as accompanying video. The presently disclosed embodiments are therefore considered in all respects to be illustrative, and not restrictive. The scope of the invention is indicated by the appended claims, rather than the foregoing description, and all changes that come within the meaning and range of equivalents thereof are intended to be embraced therein.

What is claimed is:

1. A method for modifying the temporal scale of an audio signal, comprising the steps of:

determining the emphasis of different respective portions of the audio signal relative to one another; and modifying the temporal scale of the audio signal to be produced at a rate different from the rate represented by the unmodified signal, said modification being performed in a non-uniform manner such that portions of the signal having higher relative emphasis are modified less than portions of the signal having lower relative emphasis.

2. The method of claim 1 wherein the relative emphasis is determined by measuring the energy content of the audio signal.

3. The method of claim 1 wherein the relative emphasis is determined by statistical classification of components of the audio signal which are characteristic of relative emphasis.

4. The method of claim 1 wherein said audio signal is a speech signal, and the relative emphasis is related to the stress which a speaker places on individual sounds.

5. The method of claim 4 wherein the relative emphasis is determined by interpreting an aligned transcription of the speech signal with reference to a parts-of-speech dictionary.

6. The method of claim 1 further including the step of normalizing the determined emphasis of local portions of the audio signal relative to the average emphasis over a longer portion of the signal.

7. The method of claim 6 further including the step of mapping normalized emphasis values onto a compressed scale of relative emphasis values such that higher emphasis values are compressed by a greater amount than lower emphasis values.

8. The method of claim 1 wherein a local emphasis value is determined via the following steps:

determining a maximum emphasis value for a length of the audio signal following a current portion of interest;

determining a maximum emphasis value for a length of the audio signal preceding the current portion of interest; and interpolating between said maximum emphasis values in accordance with the location of the current portion of interest relative to the locations where said maximum values occur in the audio signal.

9. The method of claim 8 wherein each current portion of interest comprises a single frame of the audio signal.

10. A method for modifying the temporal scale of a speech signal, comprising the steps of:

determining the relative emphasis of different portions of the speech signal;

determining the relative speaking rate for said different portions of the speech signal; and modifying the temporal scale of the speech signal in a non-uniform manner such that:

(a) portions of the speech signal having lower relative emphasis are modified to a greater extent than portions of the speech signal having higher relative emphasis; and (b) portions of the speech signal having a higher relative speaking rate are modified less than portions of the speech signal having lower relative speaking rate.

11. The method of claim 10 comprising the steps of determining a relative emphasis value for a portion of the speech signal, determining a relative speaking rate value for a portion of the speech signal, combining said relative emphasis value and said relative speaking rate value to form an audio tension value, selecting a nominal modification rate, adjusting said nominal modification rate in accordance with said audio tension value, and modifying the portion of the speech signal in accordance with the adjusted modification rate.

12. The method of claim 10 wherein the relative emphasis is determined by measuring the energy content of the speech signal.

13. The method of claim 10 wherein the relative emphasis is determined by statistical classification of components of the speech signal which are characteristic of relative emphasis.

14. The method of claim 10 wherein the relative emphasis is determined by interpreting an aligned transcription of the speech signal with reference to a parts-of-speech dictionary.

15. The method of claim 10 wherein the relative speaking rate is determined by measuring spectral changes in the speech signal.

16. The method of claim 10 wherein the relative speaking rate is determined by statistical classification of components of the speech signal which relate to the duration of sounds.

17. The method of claim 10 wherein the relative speaking rate is determined by interpreting an aligned transcript of the speech signal.

18. A method for modifying the temporal scale of an audio signal, comprising the steps of:

dividing the audio signal into a number of segments;

determining the energy content of individual segments relative to an average energy content over a plurality of segments;

determining a modification rate which varies continuously in accordance with the relative energy content of the individual segments; and modifying the temporal scale of the audio signal in accordance with said modification rate.

19. The method of claim 18, further including the step of determining changes in the spectral content of said individual segments, relative to one another, and wherein said modification rate is further determined in accordance with the relative changes in spectral content.

20. The method of claim 18, wherein said modification step is performed by applying a synchronous overlap and add technique to said segments.

21. The method of claim 20 further including the step of detecting significant changes in high-frequency energy content within adjacent segments of said signal, and giving priority to a segment having greater high-frequency energy content during said synchronous overlap and add technique when a significant change is detected.

22. A system for modifying the temporal scale of an audio signal, comprising:

a memory device in which an audio signal is stored;

a means for analyzing an audio signal stored in said memory device to determine the emphasis of different respective portions of the signal relative to one another;

means for generating a non-uniform modification rate in accordance with changes in the determined relative emphasis; and means for reproducing different portions of the audio signal at different temporal rates in accordance with said non-uniform modification rate.

23. The system of claim 22 wherein said analyzing means measures the energy content of the audio signal.

24. The system of claim 22 wherein said analyzing mean determines relative emphasis from statistical classification of components of the signal which are characteristic of relative emphasis.

25. The system of claim 22 wherein said audio signal is a speech signal, and said analyzing means determines relative emphasis by interpreting a time-aligned transcript of the speech signal with reference to a parts-of-speech dictionary.

26. A system for modifying the temporal scale of a speech signal, comprising:

a memory device in which a speech signal is stored;

a first means for analyzing a speech signal stored in said memory device to determine the relative emphasis of different portions of the signal;

a second means for analyzing said signal to determine changes in speaking rate;

means for generating a non-uniform modification rate in accordance with changes in the determined relative emphasis and the determined changes in speaking rate; and means for reproducing the audio signal in accordance with said non-uniform modification rate.

27. The system of claim 26 wherein said second analyzing means measures changes in the spectral content of the speech signal.

28. The system of claim 26 wherein said second analyzing means determines changes in speaking rate from statistical classification of components of the speech signal which relate to the duration of sounds.

29. The system of claim 26 wherein said second analyzing means determines changes in speaking rate by interpreting an aligned transcript of the speech signal.

30. The system of claim 26 further including means for combining the determined relative emphasis and the determined changes in speaking rate to form an audio tension value, and wherein said generating means generates a non-uniform modification rate in accordance with said audio tension value.

31. The system of claim 22 or 26, wherein said modifying system is incorporated in a voicemail system, and said non-uniform modification rate controls the rate at which recorded messages are played back to a listener.

32. The system of claim 22 or 26, wherein said modifying system is incorporated in an audio skimming system, and said non-uniform modification rate is used to adjust a nominal modification rate to form a target modification rate, that controls the rate at which an audio signal is replayed to a listener.

33. The system of claim 32, wherein said nominal modification rate is determined by analysis of the audio signal to identify characteristics that are relevant to the modification rate.

34. The system of claim 33, wherein said analysis includes a probability that the audio signal is the voice of a designated speaker.

35. A system for modifying the temporal scale of an audio signal, comprising:

a memory device in which an audio signal is stored;

a first means for analyzing an audio signal stored in said memory device to determine the energy content of the signal;

a second means for analyzing said signal to determine changes in spectral content;

means for generating a target modification rate in accordance with the determined energy content and the determined changes in spectral content; and means for reproducing the audio signal in accordance with said target modification rate.

36. The system of claim 35 wherein said first analyzing means determines average energy content for a plurality of segments of the audio signal, and determines a local energy content for each of said segments relative to said average energy content.

37. The system of claim 35 wherein said target modification rate varies in accordance with variation in said local energy content from one segment to another.

38. The system of claim 35 wherein said second analyzing means determines average spectral content for a plurality of segments of the audio signal, and determines a local spectral content for each of said segments relative to said average spectral content.

39. The system of claim 38 wherein said target modification rate varies in accordance with variation in said local spectral content from one segment to another.

40. A system for reproducing a recorded information signal with a temporal scale that is different from that at which the signal was originally generated, comprising;

a memory device in which a speech signal is stored;

a first means for analyzing a speech signal stored in said memory device to determine the relative emphasis of different portions of the signal;

a second means for analyzing said signal to determine changes in speaking rate;

means for generating a target modification rate in accordance with the determined relative emphasis and the determined changes in speaking rate; and means for reproducing the information signal in accordance with said target modification rate.

41. The system of claim 40 wherein said information signal comprises said audio signal.

42. The system of claim 40 wherein said information signal comprises a video signal that accompanies the audio signal.

43. A method for modifying the temporal scale of an audio signal, comprising the steps of:

dividing the audio signal into a number of segments;

detecting significant changes in high-frequency energy content within adjacent segments of said signal;

determining a modification rate for the temporal scale of the signal; and modifying the temporal scale during reproduction of the audio signal in accordance with said modification rate by applying a synchronous overlap and add technique to said segments, in a manner so as to give priority to a segment having greater high-frequency energy content during said synchronous overlap and add technique when a significant change is detected.

44. The method of claim 43, wherein said modification rate is constant, to provide linear compression or expansion of the audio signal during reproduction.

45. The method of claim 43, wherein said modification rate is varied for different segments during the reproduction of the audio signal.

46. The method of claim 45, wherein said modification rate is varied in accordance with the emphasis of different respective segments of the audio signal relative to one another.

* * * * *